US007640855B2

(12) United States Patent
Hoier et al.

(10) Patent No.: US 7,640,855 B2
(45) Date of Patent: Jan. 5, 2010

(54) CLAMPING DEVICE FOR A PRINTING PLATE

(75) Inventors: Günther Josef Hoier, Veitshöchheim (DE); Johannes Georg Schaede, Würzburg (DE)

(73) Assignee: KBA-Giori S.A., Lausanne (CH)

( * ) Notice: Subject to any disclaimer, the term of this patent is extended or adjusted under 35 U.S.C. 154(b) by 695 days.

(21) Appl. No.: 10/526,255

(22) PCT Filed: Aug. 28, 2003

(86) PCT No.: PCT/DE03/02863

§ 371 (c)(1),
(2), (4) Date: Nov. 29, 2005

(87) PCT Pub. No.: WO2004/024450

PCT Pub. Date: Mar. 25, 2004

(65) Prior Publication Data

US 2006/0117976 A1 Jun. 8, 2006

(30) Foreign Application Priority Data

Sep. 6, 2002 (DE) ..... 102 41 284

(51) Int. Cl.
*B41F 27/06* (2006.01)

(52) U.S. Cl. ..... 101/409; 101/378; 101/383; 101/415.1; 271/82; 271/277

(58) Field of Classification Search ..... 101/409
See application file for complete search history.

(56) References Cited

U.S. PATENT DOCUMENTS 3,650,211 A * 3/1972 Nentwich ..... 101/409
3,658,002 A 4/1972 Preuss
4,947,748 A * 8/1990 Hiltwein et al. ..... 101/409
5,168,810 A 12/1992 Kojima
5,322,013 A * 6/1994 Haupenthal ..... 101/415.1
5,374,093 A * 12/1994 Klopfenstein ..... 271/277
5,927,202 A * 7/1999 Hirokawa et al. ..... 101/415.1
6,736,396 B2 * 5/2004 Fukui ..... 101/409

FOREIGN PATENT DOCUMENTS

DE 20 06 773 B2 8/1971
DE 690 20 463 T2 3/1996
EP 0 435 410 A2 7/1991
JP 2000-218765 A 8/2000

* cited by examiner

*Primary Examiner*—Jill E Culler
(74) *Attorney, Agent, or Firm*—Crompton, Seager & Tufte, LLC

(57) ABSTRACT

Disclosed is a clamping device (02) for fastening a plate (03) to the periphery of a cylinder (01). Said clamping device (02) comprises a first clamping element (04), a pivotally mounted second clamping element (06), a spring part (07), and a bracing element that is embodied as a pivotable spindle (08) and is movable between a clamping position in which the bracing element maintains the plate in a clamped state between the clamping elements and a released position in which the clamping elements release the plate. The spindle (08) is mounted in a groove so as to be displaceable, is fixed in an intermediate space between the spring part (07) and the second clamping element (06), and is pressed against the second clamping element by means of the spring part in the clamping position.

20 Claims, 2 Drawing Sheets

CLAMPING DEVICE FOR A PRINTING PLATE

FIELD OF THE INVENTION

The invention relates to a clamping device for a printing plate on a cylinder according to the preamble of claim 1.

The subject of the invention is a cylinder having a clamping device for fastening a plate, in particular a printing plate, to the periphery of the cylinder, the clamping device comprising a first clamping element, a pivotably mounted second clamping element, a spring part and a tensioning element, which can be moved between a clamping position, in which it holds the printing plate clamped in between the clamping elements, and a released position, in which the clamping elements release the printing plate. With the cylinder for example incorporated in a rotary press, printing plates with different thicknesses, such as those which occur in what is known as the letterpress process, for example, can be fastened to the periphery of the cylinder.

PRIOR ART

A clamping device for fastening a printing plate to a press cylinder is disclosed, for example, by DE 690 20 463 T2. The clamping device comprises a clamp W for an upper edge of the printing plate and a clamp S for a lower edge of the printing plate. The two clamps W and S each comprise two clamping bars, between which the corresponding edge of the printing plate is clamped.

The necessary clamping force is respectively ensured by a tensioning spindle, which is rotatably mounted between the clamping bars. The tensioning spindle has a cross section which is substantially circular, apart from a flat. It can be rotated into a position in which it presses with a maximum diameter against the two clamping bars and, in the process, clamps the printing plate between them, or else rotated into a position in which, because of a width shortened by the flat, it can no longer exert any clamping force on the clamping bars and the printing plate is released. However, with the embodiment shown, it is not possible to set the clamping force optimally to a specific thickness of the printing plate in order to fasten printing plates of different thicknesses. For example, printing plates with a low thickness are not clamped in firmly enough or even not at all in a gap between the clamping bars, while printing plates with a greater thickness under certain circumstances cannot even be inserted into the gap between the clamping bars.

In EP 04 35 410 B2, a clamping device that is configured differently is shown. In the case of this clamping device, too, an edge of the printing plate is clamped in between two clamping bars. One of the clamping bars is pivotably mounted and is pressed against the other clamping bar by a resilient spring. In order to open the two clamping bars, a spindle with an eccentric cross section is provided, with which the pressure of the resilient spring can be counteracted. Although, in the case of this device, in the event of different thicknesses of the printing plate, the resilient spring is pressed in to different extents, which leads to a correspondingly changed spring force and therefore to a changed clamping force for the printing plate, this clamping force is firstly weak, because the resilient spring can exert only small spring forces, as a result of which printing plates with an excessively high thickness cannot be held in this clamping device. Secondly, during the insertion of the printing plate between the clamping bars, care must be taken that the spindle acts permanently counter to the spring force. This requires a fixing mechanism for the spindle, which means increased mechanical complexity, since without such a fixing mechanism there is the risk that, during the insertion of the printing plate, the spindle will slip and release the pivotable clamping bar again, which will then be pressed immediately against the other clamping bar because of the spring force. However, even with such a fixing device for the spindle, the insertion of the printing plate is cumbersome and associated with a risk of injury, since, in particular when the printing plate has a great thickness, it has a certain stiffness, which has to be overcome when bending over the printing plate and introducing it between the two clamping bars.

As a consequence of this stiffness, the printing plate continually attempts to bend back again, so that it has to be held between the clamping bars while the fixing device for the spindle is released, in order that the clamping bars are able to grip the printing plate. In this case, there is the risk to a person holding the printing plate that his fingers will be clamped in between the clamping bars. If the printing plate is mounted by only one person, the risk of injury is increased considerably, since he has to hold the printing plate with one hand while he simultaneously has to operate the fixing device for the spindle with the other hand.

DE 26 06 773 B2 discloses a device for fastening a printing plate on a cylinder, in which the printing plates are held between fixed clamping bars and movable clamping elements. The clamping elements are moved by a pivotable, flattened spindle by means of interposed disk springs.

SUMMARY OF THE INVENTION

The invention is based on the object of providing a clamping device for a printing plate.

According to the invention, the object is achieved by the features of claim 1.

The advantages that can be achieved with the invention are in particular that printing plates with different thicknesses can be fastened to the cylinder. By means of the special design of the clamping device, it is ensured that each printing plate experiences a clamping force from the clamping device which corresponds to its thickness, and is gripped securely by the clamping elements. Furthermore, the play of the tensioning element between the clamping elements in the released position prevents the clamping elements inadvertently snapping shut and, as a result, reduces the risk of injury. In addition, the mounting of the printing plate is simplified considerably, since it can firstly be introduced carefully between the clamping elements and is held by the latter before it is acted on with a clamping force by moving the tensioning element into the clamping position.

The spring part preferably comprises at least one disk spring. As opposed to tensioning springs, disk springs have a considerably greater spring constant with a compact design and are therefore capable of exerting a much higher spring force with less compression. This permits a more compact and space-saving design of the clamping device, which is additionally capable of holding printing plates with a thickness in which a clamping device designed with resilient springs could not supply the clamping force needed for this purpose.

The clamping device is preferably arranged in an elongated groove in the cylinder. Because the clamping device is countersunk completely in the groove, the cylinder can be used, for example, as a plate cylinder in a rotary press without the clamping device impeding the printing operation.

In this case, a clamping device which can be displaced within the groove is particularly preferred. Using such a clamping device, the printing plate held by the clamping device can be tensioned by displacing the clamping device in the peripheral direction within the groove, so that the printing plate rests closely on the periphery of the cylinder, or can be displaced as a whole in the peripheral direction. The clamping device can also be displaceable along the groove. In a machine which has a plurality of plate cylinders for multicolor printing, the individual printing plates can be adjusted in register with the aid of such clamping devices.

In this case, at least one of the clamping elements is preferably a bar running parallel to the groove. By using such bars, a printing plate can be clamped in along an entire length of one of its end sections, which improves the clamping.

One side of the first clamping element, with which the first clamping element clamps the printing plate, preferably has a curved profile in section transversely with respect to the axis of the cylinder. In this case, depending on the suitability, the curved profile can be curved in the shape of a circular arc or a section of an ellipse or in any other desired way. Such a configuration of the first clamping element benefits kink-free clamping of the printing plate.

Likewise preferred is a tensioning element which is a spindle running parallel to the groove. In the case of bar-like clamping elements, by means of a tensioning element embodied in this way, a clamping force may be applied along an entire length of the clamping elements, which benefits the secure clamping of the printing plate.

The spindle preferably has a cross section substantially in the form of a circular segment with a first flat. Such a spindle may be moved from the clamping position into the released position and vice versa by means of simple rotation. Here, in the released position, the flat is oriented substantially toward one of the two clamping bars, which results in the play of the spindle in the interspace between the clamping bars.

A further embodiment of the spindle has a second flat and a third flat, which are arranged diametrically with respect to each other on the spindle, in the clamping position the second flat pressing against the second clamping element and the third flat being pressed by the spring part. The second and the third flat have the effect that the spindle latches in the clamping position.

There are advantageously pins in one of the clamping elements, on which pins the printing plate is hooked in. By virtue of the pins, the mounting of the printing plate is simplified further, since it is prevented from sliding out between the two clamping elements.

As already mentioned, the cylinder is particularly preferably a part of a rotary press.

An exemplary embodiment of the invention is illustrated in the drawings and will be described in more detail in the following text.

DESCRIPTION OF THE PREFERRED EMBODIMENTS

Figure 1:
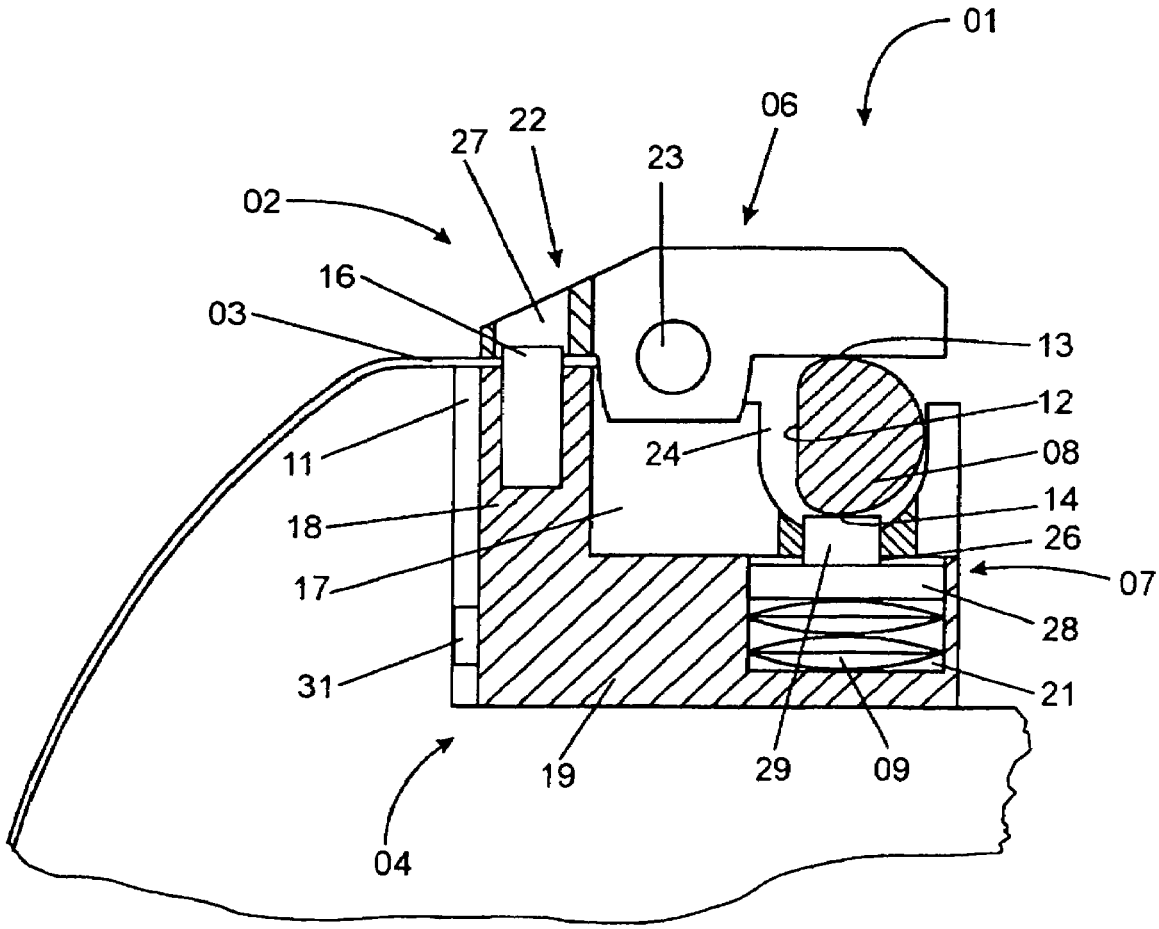
FIG. 1 shows a cross section through a part of a cylinder and a clamping device.

FIG. 1 shows a cross section through a part of a cylinder 01 with an associated clamping device 02. In this case, the clamping device 02 is arranged within a longitudinal groove 11 in the cylinder 01 and entirely accommodated in this groove 11. Fastened to the periphery of the cylinder 01 is a plate 03, for example a printing plate 03, which is bent down in one end section and is clamped in the clamping device 02.

The clamping device 02 includes a first clamping element 04, a second clamping element 06, a bearing block 17 having a spring part 07 and a tensioning element 08. The first clamping element 04 is an L-profile bar 04 extending through the length of the groove 11. Arranged in a limb 18 of the L-profile bar 04 which is vertical in the drawing are pins 16, which project with one end section out of the end of the limb 18 and reach with a form fit through holes in the edge of the printing plate 03. In a limb 19 of the L-profile bar 04 which is horizontal in FIG. 1, on the side of the limb 18, a recess 21 is provided in an end section of the limb 19 opposite the limb 18. The L-profile bar 04 is arranged within the groove 11 in such a way that the limb 18 is oriented toward an aperture 22 of the groove 11 in the surface of the cylinder 01, and the limb 19 points away from the aperture 22.

The bearing block 17 rests on the horizontal limb 19 of the L-profile bar 04 and on the vertical limb 18. At an end section facing the vertical limb 18, the bearing block 17 has a rotary bearing 23. In an end section facing away from the vertical limb 18, the bearing block 17 has a channel-like groove 24 running parallel to the groove 11. The second clamping element 06 is attached to the rotary bearing 23, while the groove 24 serves as a bearing 24 for the tensioning element 08. At the lowest point of the bearing 24 an aperture 26 is provided as an engagement for the spring part 07.

The second clamping element 06 extends through the length of the groove 11 and is attached to the rotary bearing 23 such that it can pivot about a longitudinal axis. Thus, the clamping element 06 acts like a two-armed lever. A lever arm facing the aperture 22 forms a clamping bar 06, which rests on the vertical limb 18 of the L-profile bar 04. The clamping bar 06 has holes 27, into which the pins 16 projecting from the limb 18 project.

The tensioning element 08 is a spindle 08 which extends through the length of the groove 11. The spindle 08 substantially has a cross section in the form of a circular segment with a wide first flat 12. Provided on the spindle 08, diametrically with respect to each other, are two further flats 13 and 14, which are parallel to each other and are both arranged at right angles to the flat 12. The flats 13 and 14 are much narrower than the flat 12. The spindle 08 extends over the entire length of the bearing block 17 and is rotatably mounted in its groove 24. The spacing of the flats 13, 14 from the axis of rotation of the spindle 08 corresponds to the radius of curvature of the part of the cross section that is in the form of a circular segment; the spacing of the flat 12 from the axis of rotation is smaller.

The spring part 07 comprises a plurality of springs 09, for example disk springs 09, on which a plate 28 is mounted. The plate 28 has a protrusion 29 on a side facing away from the disk springs 09. The disk springs 09 and the plate 28 are accommodated by the recess 21 in the horizontal limb 19 of the L-profile bar 04. In this case, the protrusion 29 reaches through the aperture 26 in the bearing block 17 into the interior of the bearing 24 and presses against the spindle 08 located in the latter.

When the spindle 08 is in a released position, it is oriented with the first flat 12 either toward a lever arm of the clamping bar 06 facing away from the aperture 22 or toward the protrusion 29 of the spring part 07. It then has play within the bearing 24, that is to say in an interspace between the spring part 07 or the protrusion 29 of the spring part 07 and the clamping bar 06. The disk springs 09 press the plate 28 against the bearing block 17. The clamping bar 06 can pivot freely about the rotary bearing 23 and can be pivoted back in order to release the pins 16.

Figure 2:
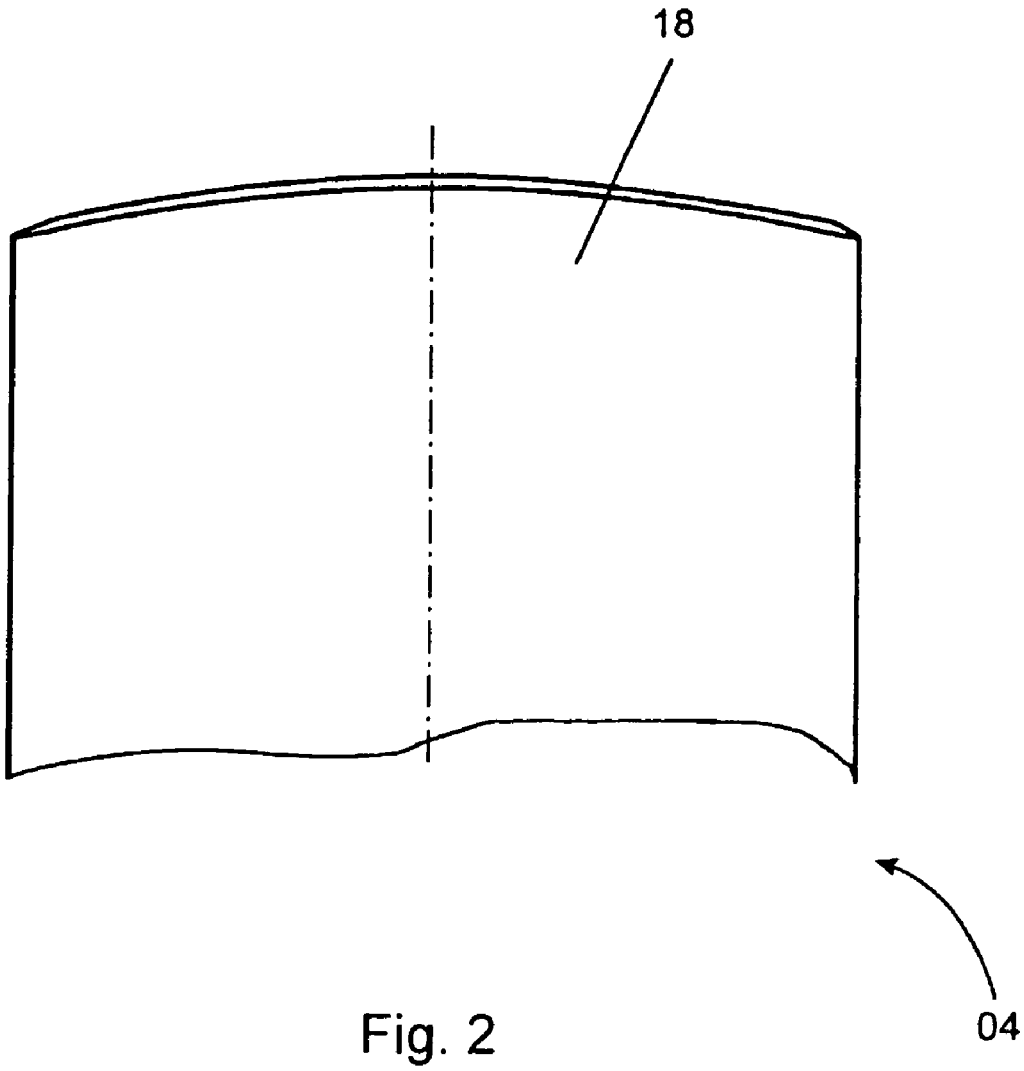
FIG. 2 shows a front view of a first clamping element.

In order to fasten the printing plate 03, first of all an edge section of the printing plate 03 provided with holes is pushed through the aperture 22 in the groove 11 in the periphery of the cylinder 01 and hooked onto the pins 16 by means of the holes. The printing plate 03 is then bent around the cylinder 01 and an opposite edge section is hooked in a second groove 11 in the same way. In order to avoid the bending leading to permanent deformation of the printing plate 03, the limb 18 of the L-profile bar 04 has a curved profile in section transversely with respect to an axis of the cylinder 01, as shown in FIG. 2. In the embodiment of the L-profile bar 04 shown, the curvature has the form of a circular section.

In order to clamp the printing plate 03 between the two clamping elements 04 and 06, the spindle 08 is rotated into the clamping position shown in FIG. 1. In this position, it presses with its second flat 13 against the clamping bar 06 and with the third flat 14 against the protrusion 29 of the spring part 07. In order to assume this position, an additional expenditure of force, which can easily be applied, is necessary so that the spindle 08 is latched in the clamping position by virtue of the flats 13 and 14. The disk springs 09 are compressed by the spindle 08 via the protrusion 29. They react to this with a spring force which, via the protrusion 29, acts on the spindle 08 and on the second clamping element 06. Since the second clamping element 06 acts like a two-armed lever as a result of its pivotable mounting on the rotary bearing 23, the printing plate 03 is clamped in between the clamping bar 06 of the second clamping element 06 and the limb 18 of the L-profile bar 04.

Depending on the thickness of the printing plate 03 clamped in, the disk springs 09 are compressed either more or less and react with a correspondingly different spring force, that is to say the clamping force for the printing plate 03 increases with the thickness of the printing plate 03, since the disk springs 08 are compressed to a greater extent with increasing thickness of the printing plate 03. Thus, in this embodiment of the clamping device 02, a clamping force corresponding to the thickness of the printing plate 03 is automatically established by itself.

After the printing plate 03 has been clamped in between the L-profile bar 04 and the clamping element 06, the clamping device 02 is pushed away from the aperture 22 within the groove 11, in order to tension the printing plate 03 on the periphery of the cylinder 01. For this purpose, a tensioning screw 31 is provided, which strikes a wall of the groove 11 and with which the clamping device 02 can be displaced toward the aperture 22 or away from the aperture 22 within the groove 11.

After printing has been carried out, the printing plate 03 is removed from the cylinder 01 by the spindle 08 being rotated into the released position again, in which said plate has play in the interspace between the spring part 07 and the second clamping element 06, so that the second clamping element 06 can again be pivoted freely. Now, the clamping bar 06 of the second clamping element 06 can easily be pivoted back, as a result of which the pins 16 are exposed and the printing plate 03 can be unhooked from the pins 16.

The invention is not restricted to the embodiment described. Instead, alternative configurations of the clamping device 02 shown are possible without departing from the idea of the invention. For example, in the described configuration of the clamping device 02, the first clamping element 04 or the L-profile bar 04 is a bar that extends over the entire length of the groove 11, the second clamping element 06 also being configured as a continuous bar. As an alternative to this, the second clamping element 06 can be composed of a plurality of clamping levers which are attached to a plurality of bearing blocks 17. Likewise, the first clamping element 04 can be composed of a plurality of L-profile pieces 04, on which the bearing blocks 17 rest, instead of being formed as a continuous L-profile bar 04. Quite generally, the first clamping element 04 and the second clamping element 06 can be formed in any desired combination in one piece as bars or can be composed of a plurality of pieces.

LIST OF DESIGNATIONS

01 Cylinder
02 Clamping device
03 Plate, printing plate
04 First clamping element, L-profile bar
05 -
06 Second clamping element, clamping bar
07 Spring part
08 Tensioning element, spindle
09 Spring, disk springs
10 -
11 Groove
12 First flat
13 Second flat
14 Third flat
15 -
16 Pin
17 Bearing block
18 Vertical limb
19 Horizontal limb
20 -
21 Recess
22 Aperture
23 Rotary bearing
24 Groove, bearing
25 -
26 Aperture
27 Holes
28 Plate
29 Protrusion
30 -
31 Tensioning screw

The invention claimed is:

1. A clamping device for fastening a plate to the periphery of a cylinder, the clamping device comprising a first clamping element, a pivotably mounted second clamping element, a spring part and a tensioning element which is formed as a pivotable spindle which can be moved between a clamping position, in which it holds the plate clamped in between the clamping elements, and a released position, in which the clamping elements release the plate, wherein the spindle is mounted rotably in a groove, wherein the spindle is fitted in an interspace between the spring part and the second clamping element wherein, in the clamping position, the spindle is pressed against the second clamping element by the spring part, and wherein, in the released position, the clamping device has a play in the interspace between the spring part and the second clamping element.

2. The clamping device as claimed in claim 1, wherein the spring part comprises at least one disk spring.

3. The clamping device as claimed in claim 1, wherein the clamping device is arranged in an elongated groove in the cylinder.

4. The clamping device as claimed in claim 3, wherein the clamping device can be displaced within the groove.

5. The clamping device as claimed in claim 3, wherein at least one of the clamping elements is a bar running parallel to the groove.

6. The clamping device as claimed in claim 3, wherein one side of the first clamping element, with which the first clamping element clamps the plate, has a curved profile in section transversely with respect to the axis of the cylinder.

7. The clamping device as claimed in claim 3, wherein the spindle is arranged to run parallel to the groove.

8. The clamping device as claimed in claim 7, wherein the spindle has a cross section substantially in the form of a circular segment with a first flat.

9. The clamping device as claimed in claim 8, further comprising a second flat and a third flat, which are arranged diametrically with respect to each other on the spindle, in the clamping position the second flat pressing against the second clamping element and the third flat being pressed by the spring part.

10. The clamping device as claimed in claim 1, wherein there are pins on one of the clamping elements, on which pins the plate is hooked in.

11. The clamping device as claimed in claim 1, wherein the cylinder is arranged in a rotary press.

12. The clamping device as claimed in claim 1, wherein the spindle has eccentric sections.

13. A clamping device for fastening a plate to the periphery of a cylinder, the clamping device comprising a first clamping element, a pivotably mounted second clamping element, a spring part and a tensioning element which is formed as a pivotable spindle which can be moved between a clamping position, in which it holds the plate clamped in between the clamping elements, and a released position, in which the clamping elements release the plate, wherein the spindle is mounted in a variable location in a groove, wherein the spindle is fined in an interspace between the spring part and the second clamping element wherein, in the clamping position, the spindle is pressed against the second clamping element by the spring part, wherein the clamping device is arranged in an elongated groove in the cylinder, wherein the spindle is arranged to run parallel to the groove, wherein the spindle has a cross section substantially in the form of a circular segment with a first flat, further comprising a second flat and a third flat, which are arranged diametrically with respect to each other on the spindle, in the clamping position the second flat pressing against the second clamping element and the third flat being pressed by the spring part.

14. The clamping device as claimed in claim 13, wherein the spring part comprises at least one disk spring.

15. The clamping device as claimed in claim 13, wherein the clamping device can be displaced within the groove.

16. The clamping device as claimed in claim 13, wherein at least one of the clamping elements is a bar running parallel to the groove.

17. The clamping device as claimed in claim 13, wherein one side of the first clamping element, with which the first clamping element clamps the plate, has a curved profile in section transversely with respect to the axis of the cylinder.

18. The clamping device as claimed in claim 13, wherein there are pins on one of the clamping elements, on which pins the plate is hooked in.

19. The clamping device as claimed in claim 13, wherein the cylinder is arranged in a rotary press.

20. The clamping device as claimed in claim 13, wherein the spindle has eccentric sections.

* * * * *

UNITED STATES PATENT AND TRADEMARK OFFICE

CERTIFICATE OF CORRECTION

PATENT NO. : 7,640,855 B2
APPLICATION NO. : 10/526255
DATED : January 5, 2010
INVENTOR(S) : Günther Josef Hoier and Johannes Georg Schaede It is certified that error appears in the above-identified patent and that said Letters Patent is hereby corrected as shown below:

Column 8
Line 3: delete "fined" and insert therefor -- fitted --.

Signed and Sealed this

Twelfth Day of October, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,640,855 B2
APPLICATION NO. : 10/526255
DATED : January 5, 2010
INVENTOR(S) : Hoier et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1072 days.

Signed and Sealed this

Sixteenth Day of November, 2010

David J. Kappos

David J. Kappos
*Director of the United States Patent and Trademark Office*